US009157692B2

(12) United States Patent
Salva

(10) Patent No.: US 9,157,692 B2
(45) Date of Patent: Oct. 13, 2015

(54) RIFLE WITH A NOISE DAMPER

(71) Applicant: Gamo Outdoor, S.L., Sant Boi de Llobregat, Barcelona (ES)

(72) Inventor: Francisco Casas Salva, Sant Boi de Llobregat (ES)

(73) Assignee: GAMO OUTDOOR S.L., Barcelona (ES)

( * ) Notice: Subject to any disclaimer, the term of this patent is extended or adjusted under 35 U.S.C. 154(b) by 0 days.

(21) Appl. No.: 14/259,809

(22) Filed: Apr. 23, 2014

(65) Prior Publication Data

US 2015/0159971 A1 Jun. 11, 2015

Related U.S. Application Data

(60) Division of application No. 13/564,868, filed on Aug. 2, 2012, which is a continuation of application No. 12/522,659, filed as application No. PCT/IB2007/054413 on Oct. 31, 2007, now Pat. No. 8,261,651.

(30) Foreign Application Priority Data

Jan. 12, 2007 (ES) ..... 200700101 U

(51) Int. Cl.
*F41A 21/00* (2006.01)
*F41A 21/30* (2006.01)
(Continued)

(52) U.S. Cl.
CPC ..... *F41A 21/30* (2013.01); *F41A 21/02* (2013.01); *F41A 21/325* (2013.01); *Y10T 29/49826* (2015.01)

(58) Field of Classification Search
CPC ..... F41A 21/30; F41A 21/32; F41A 21/34; F41A 21/36; F41A 21/38
USPC ..... 89/14.05, 14.2, 14.3, 14.4, 16; 42/76.01, 76.02; 181/223
See application file for complete search history.

(56) References Cited

U.S. PATENT DOCUMENTS

| | | | |
|---|---|---|---|
| 916,885 | A | 3/1909 | Maxim |
| 1,017,003 | A | 2/1912 | Kenney |

(Continued)

FOREIGN PATENT DOCUMENTS

| | | |
|---|---|---|
| AT | 153280 | 4/1938 |
| DE | 1 553 966 | 7/1971 |

(Continued)

OTHER PUBLICATIONS

Menier, Renan, International Preliminary Report on Patentability for International Application No. PCT/IB2007/054413 dated Apr. 23, 2009, 7 pages.

(Continued)

*Primary Examiner* — Gabriel Klein
(74) *Attorney, Agent, or Firm* — RatnerPrestia

(57) ABSTRACT

A rifle barrel having a sound suppressor and a rifle comprising such a barrel. Material disposed over the rifle barrel and extending longitudinally and distally from a proximal end of the rifle barrel defines a housing. The housing surrounds at least a majority of the sound suppressing element, which is connected to the rifle barrel solely by containment within the housing. The sound suppressing comprises an acoustic labyrinth formed by a plurality of components disposed together along a longitudinal plane coextensive with an axis of the rifle barrel.

21 Claims, 4 Drawing Sheets

(51) Int. Cl.
*F41A 21/02* (2006.01)
*F41A 21/32* (2006.01)

(56) References Cited

U.S. PATENT DOCUMENTS

| | | | | | |
|---|---|---|---|---|---|
| 1,111,202 | A | | 9/1914 | Westfall | |
| 1,605,864 | A | * | 11/1926 | Steinegger | 89/14.3 |
| 2,448,382 | A | | 8/1948 | Mason | |
| 2,451,514 | A | * | 10/1948 | Sieg | 89/14.3 |
| 3,299,558 | A | | 1/1967 | Karl | |
| 4,213,375 | A | | 7/1980 | Pedler | |
| 4,584,924 | A | | 4/1986 | Taguchi | |
| 4,769,938 | A | | 9/1988 | Chesnut et al. | |
| 5,315,914 | A | | 5/1994 | Schumacher | |
| 6,079,311 | A | | 6/2000 | O'Quinn et al. | |
| 6,412,389 | B2 | | 7/2002 | Fluhr | |
| 6,575,074 | B1 | | 6/2003 | Gaddini | |
| 6,701,820 | B2 | | 3/2004 | Fluhr | |
| 6,758,004 | B2 | | 7/2004 | Huston | |
| 7,073,426 | B1 | | 7/2006 | White | |
| 8,261,651 | B2 | | 9/2012 | Casas Salva | |
| 8,881,862 | B1 | * | 11/2014 | Messer et al. | 181/223 |
| 2008/0251060 | A1 | | 10/2008 | Thurber | |
| 2010/0126334 | A1 | * | 5/2010 | Shults et al. | 89/14.4 |

FOREIGN PATENT DOCUMENTS

| | | |
|---|---|---|
| DE | 28 25 899 | 3/1979 |
| DE | 37 00 398 | 7/1987 |
| DE | 42 31 183 | 3/1994 |
| DE | 695 06 416 | 6/1999 |
| DE | 199 35 929 | 2/2001 |
| DE | 100 01 374 | 6/2001 |
| EP | 0 772 758 | 5/1997 |
| EP | 0 961 096 | 12/1999 |
| EP | 1 117 970 | 7/2001 |
| EP | 1 247 057 | 10/2002 |
| GB | 2 104 197 | 3/1983 |
| GB | 2 193 562 | 2/1988 |
| WO | WO 94/07103 | 3/1994 |
| WO | WO 96/03612 | 2/1996 |

OTHER PUBLICATIONS

Menier, Renan, Written Opinion for International Application No. PCT/IB2007/054413 dated Mar. 28, 2008, 5 pages.
Hafner, Dieter, Nullity Action (in German, 17 pages, with English translation, 15 pages) dated Oct. 8, 2012.
US Office Action for U.S. Appl. No. 13/564,868 dated Sep. 17, 2014, 15 pages.

* cited by examiner

RIFLE WITH A NOISE DAMPER

CROSS-REFERENCE TO RELATED APPLICATIONS

This application is a divisional application of U.S. patent application Ser. No. 13/564,868, filed Aug. 2, 2012, which is a continuation of U.S. patent application Ser. No. 12/522,659, filed Nov. 9, 2009 (status: granted as U.S. Pat. No. 8,261,651 on Sep. 11, 2012), which is a National Stage of International Application No. PCT/IB2007/054413, filed Oct. 31, 2007, which claims the benefit of Spanish Patent Application No. U 200700101, filed Jan. 12, 2007, the disclosures of all of the foregoing of which are incorporated herein by reference.

BACKGROUND OF THE INVENTION

A rifle comprising a barrel, a bore within the barrel, and a noise damper, wherein the noise damper is over-molded or over-injected on the barrel so that the barrel and noise damper form a single part.

Various silencers and mechanisms to couple the silencer to the barrel of a carbine or pistol are known in the state of the art.

For example, European Patent No 1247057, of 2000, in the name of the company HECKLER & KOCH GMBH is known, which discloses a coupling device to secure a silencer on the barrel of a portable firearm that comprises a fastening for securing the silencer on the barrel of the portable firearm, where the silencer essentially has the form of a tube, with a coupling bracket fitted to the rear end of the silencer, and a barrel mouth that adjusts to the coupling bracket, on which the coupling bracket can be secured, and the barrel mouth presents a non-round configuration, where a supplementary part is installed on the coupling bracket on the side opposite the first and which can rotate with a contra-form complementary to the non-round configuration, so that the supplementary part can be secured to the barrel mouth only in one angular position. The silencer, together with the coupling bracket, is positioned so that it can rotate with respect to the supplementary part, and a blocking device is planed for inclusion, which will immobilize the silencer, together with the coupling bracket on the supplementary part, at a chosen angular position, without it being able to rotate.

The same company also owns European Patent No 1117970 of 2000, which discloses a coupling device for securing a silencer onto the barrel of a portable firearm including a fastening for securing the silencer onto the barrel of the portable firearm with a retention projection, which is positioned on the silencer, and which presents an orifice that centers a contra-projection, which is positioned on the barrel and which presents centered adjustment surfaces that adjust in the orifice, and a pin that can be dismounted for securing the retention projection on the contra-projection, so that the orifice and the adjustment surfaces are positioned centrally in a consecutive fashion in a seating zone, and with which at least one expansion space is provided between the two axial ends of the seating zone.

Lastly, European Patent 0772758 dated 1995 is also known, in the name of Mr. Bernard Louvat, which discloses a silencer for a clay-pigeon or sports shotgun. It comprises a tubular body that adapts over the barrel(s) of the firearm and has a ring-shaped decompression chamber behind the tubular body, together with a series of internal transversal baffles held in place by separation parts, and includes orifices that allow the lead shot to pass through and wad evacuation. The silencer is adaptable to all calibers of clay-pigeon and sports shotguns and rifles, single or double-barrel, side-by-side or over/under, together with gauge 12 or 14 garden rifles.

BRIEF DESCRIPTION OF THE INVENTION

This invention is a considerable advance in the sporting and fire rifles sector because it increases the performance of the firearm and reduces noise.

Economic advantages of the invention arise from a noise damper that is over-molded or over-injected on the barrel of an sporting or fire rifle so that the barrel and noise damper are a single integral assembly.

In view of the noise damper being manufactured by over-molding or over-injection, the invention also offers significant economic advantages in terms of the production of barrels with noise dampers, since barrels and their noise dampers are usually two independent parts.

As discussed above, the prior art typically requires mechanisms to couple the noise damper to the barrel. The coupling must provide stability (no movement) as well as firing reliability. In other words, it has to fit and, at the same time, remain calibrated with the front and rear sights centered. This is a problem, since centering is required each time the noise damper is coupled to the barrel. In contrast, centering of the sights is not necessary in the exemplary rifle disclosed herein in that the front and rear sights are always centered because the front sight is fixed to the noise damper, which is over-molded or over-injected onto the barrel.

The noise damper also has an improved noise damper insulating mechanism. Traditionally, a series of loose parts are employed in noise dampers, which are then generally wrapped in cotton or similar materials. The exemplary rifle disclosed herein includes a noise damper comprising at least two parts that define an acoustic labyrinth, which is an evident saving from the economic point of view, since the acoustic labyrinth is very easy to install and manufacture. This feature also offers a significant technical improvement, because when the parts are coupled inside the barrel, they correctly center the exit pathway for the bullet or pellet.

An exemplary embodiment described herein provides an sporting or fire rifle comprising a barrel, a bore within the barrel, and a noise damper, wherein the noise damper is over-molded or over-injected on the barrel so that the barrel and noise dampener form a single, integral part.

BRIEF DESCRIPTION OF THE DRAWINGS

In order to facilitate the description, the present description is accompanied by four sheets of drawings that show an exemplary embodiment, which is cited as a non-limiting example of the scope of the present invention.

DETAILED DESCRIPTION OF THE INVENTION

Figure 1:
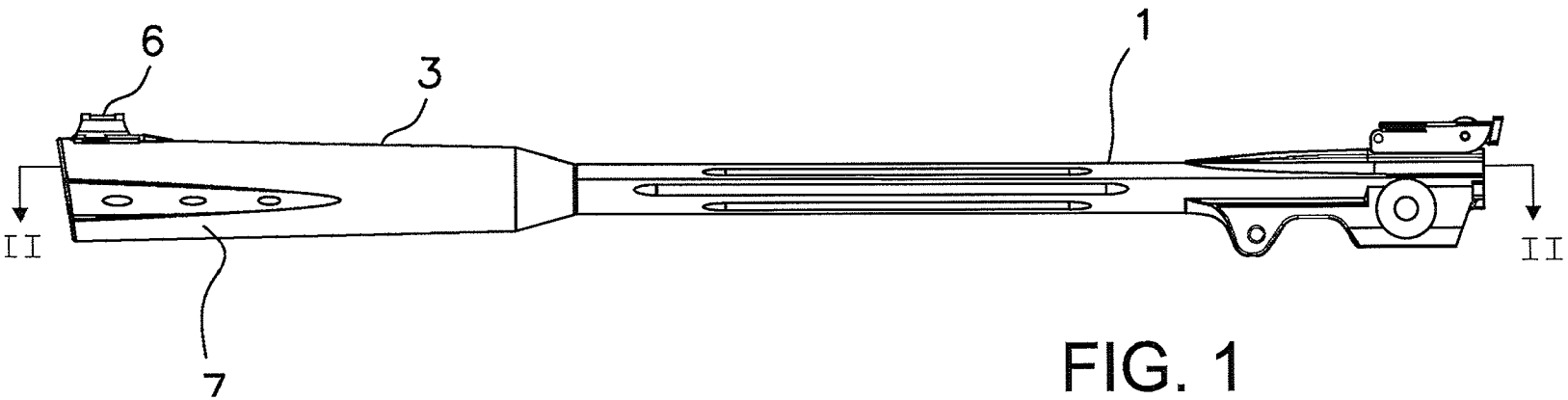
FIG. 1 is a side view of an sporting or fire rifle according to the exemplary embodiment of this invention.

FIG. 1 illustrates an sporting or fire rifle comprising a barrel 1 with a bore therein, a sight 6, and a noise damper 3 that has been over-molded or over-injected on the barrel 1.

Figure 2:
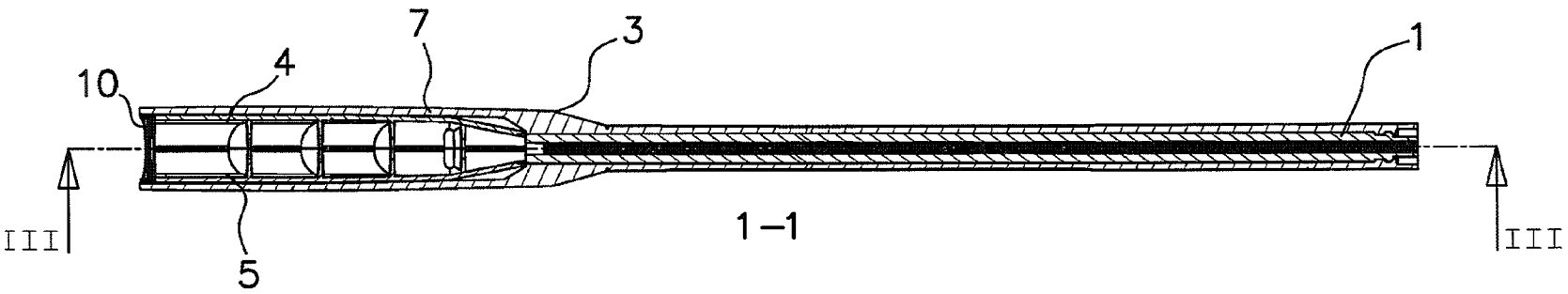
FIG. 2 is a cross-sectional view taken through line II-II of FIG. 1.

FIG. 2 illustrates the barrel 1, the noise damper 3, two parts 4 and 5 of the noise damper 3, and a cover 10.

Figure 3:
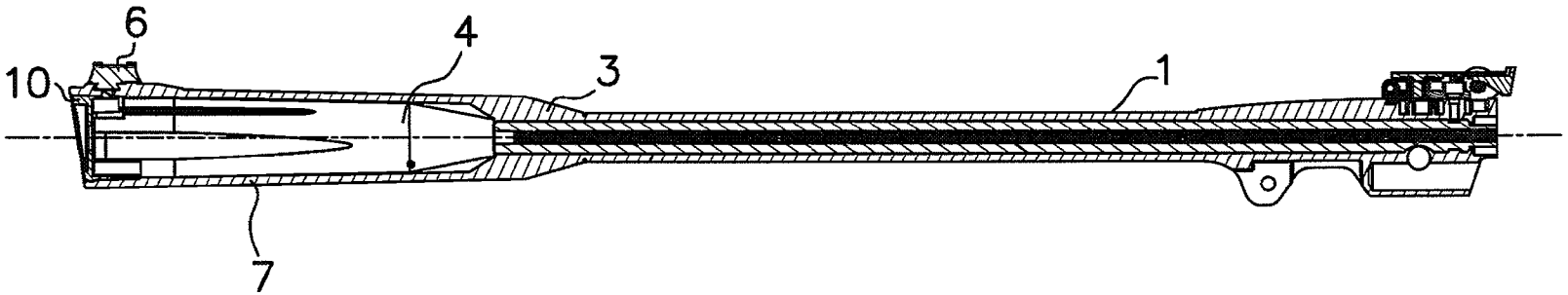
FIG. 3 is a cross-sectional view taken through line III-III of FIG. 2.

FIG. 3 shows the barrel 1, the noise damper 3, the cover 10, the sight 6 and an over-molded or over-injected housing 7 that encloses the parts 4 and 5.

Figure 4:
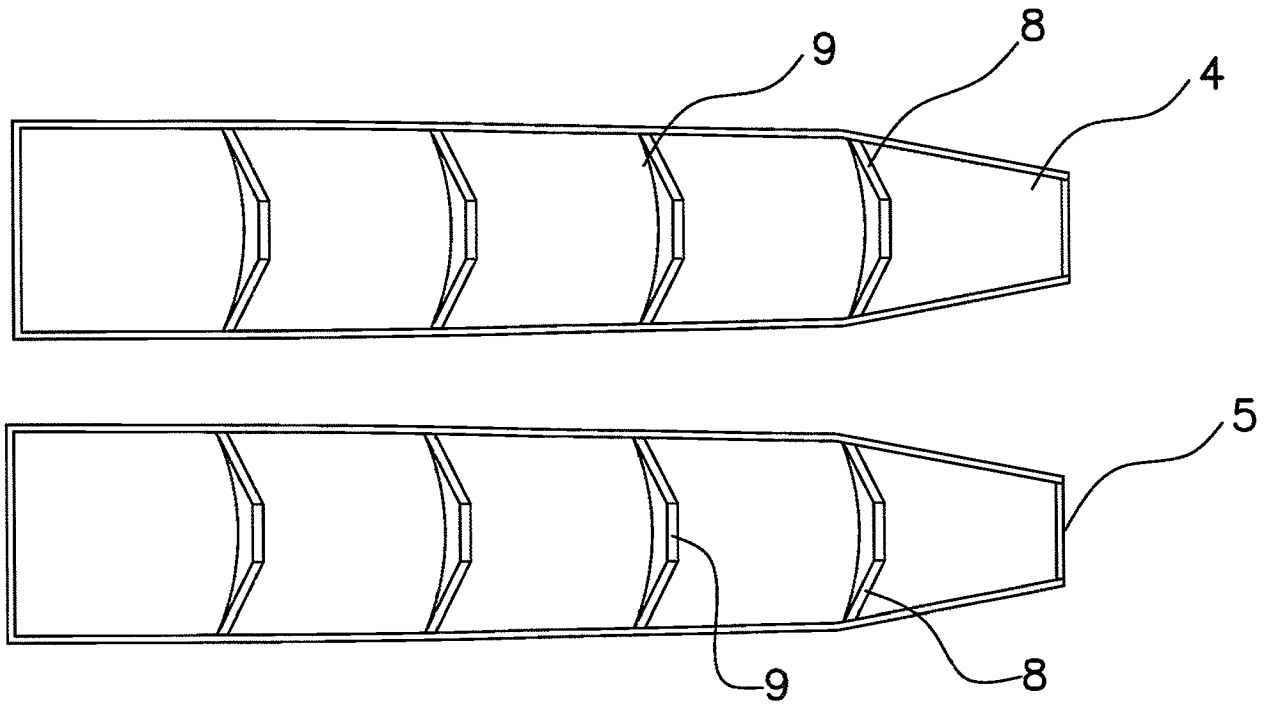
FIG. 4 illustrates two parts of the noise damper of the rifle of FIGS. 1 through 3.

Finally, FIG. 4 shows the parts 4 and 5, each comprising partitions 8 and neckings 9. In an exemplary embodiment, as shown in FIG. 1, the noise damper 3 is over-molded or over-injected on the barrel 1.

In this way, the noise damper 3 and the barrel 1 form a single, integral part.

As can be seen in the section of FIG. 2, the two parts 4 and 5 of the noise damper 3 within the housing 7 define an insulating mechanism of the noise damper 3 by defining an acoustic labyrinth that ends with the cover 10 and provides damping of the firing noise.

Upon assembling the parts 4 and 5, the partitions 8 and the neckings 9 on the partitions 8 define a space or passage between the two parts 4 and 5 as an extension of the bore within the barrel 1.

In an exemplary embodiment, the sight 6 can be fixed onto the noise damper 3, as illustrated in FIG. 1.

This disclosure describes a new sporting or fire rifle with a noise damper. The examples described here do not limit the present invention, which may have various applications and/or adaptations, all of which are within the scope of the following claims.

What is claimed is:

1. A rifle barrel having a sound suppressor, comprising:

a structure defining a housing comprising a material disposed over the rifle barrel and extending longitudinally and distally from a proximal end of the rifle barrel in a firing direction of the rifle barrel; and a sound suppressing element positioned within the housing such that the housing houses and radially surrounds the sound suppressing element and couples the sound suppressing element to the rifle barrel, the sound suppressing element comprising an acoustic labyrinth formed by a plurality of mating components disposed together along a longitudinal plane coextensive with an axis of the rifle barrel, the mating components having opposing mating faces that are coplanar with the longitudinal plane.

2. The rifle barrel of claim 1, wherein the plurality of mating components disposed together consists of two parts.

3. The rifle barrel of claim 1, wherein the sound suppressing element is disposed adjacent the proximal end of the rifle barrel.

4. The rifle barrel of claim 1, wherein the sound suppressing element defines a passage that comprises a longitudinal extension of a bore of the rifle barrel.

5. The rifle barrel of claim 1, wherein the sound suppressing element is entirely housed within the housing adjacent the proximal end of the rifle barrel.

6. The rifle barrel of claim 1, wherein the acoustic labyrinth comprises a plurality of partitions.

7. The rifle barrel of claim 1, further comprising a cover on a distal end of the housing.

8. The rifle barrel of claim 1, further comprising a sight affixed to the structure.

9. The rifle barrel of claim 8, wherein the sight is a front sight.

10. The rifle barrel of claim 1, wherein a portion of the structure is in direct contact with the rifle barrel.

11. The rifle barrel of claim 10, wherein the material disposed over the rifle barrel comprises material over-molded or over-injected onto to rifle barrel.

12. The rifle barrel of claim 1, wherein the material disposed over the rifle barrel consists of material over-molded or over-injected onto to rifle barrel.

13. The rifle barrel of claim 12, wherein a portion of the material over-molded or over-injected onto to rifle barrel is in direct contact with the rifle barrel.

14. The rifle barrel of claim 1, wherein the sound suppressing element defines a longitudinal central passage between the plurality of components that comprises a longitudinal extension of a bore of the rifle barrel.

15. The rifle barrel of claim 1, wherein the structure is coupled to the rifle barrel to provide no movement therebetween.

16. The rifle barrel of claim 1, wherein the structure is coupled to the rifle barrel such that the structure and the rifle barrel form a single piece.

17. The rifle barrel of claim 1, wherein the housing surrounds a majority of the sound suppressing element.

18. The rifle barrel of claim 17, wherein the housing entirely surrounds the sound suppressing element.

19. A rifle having a sound suppressor, comprising: a structure defining a housing comprising a material disposed over the rifle barrel and extending longitudinally and distally from a proximal end of the rifle barrel in a firing direction of the rifle barrel; and a sound suppressing element positioned within the housing such that the housing houses and radially surrounds the sound suppressing element and couples the sound suppressing element to the rifle barrel, the sound suppressing element comprising an acoustic labyrinth formed by a plurality of mating components disposed together along a longitudinal plane coextensive with an axis of the rifle barrel, the mating components having opposing mating faces that are coplanar with the longitudinal plane; wherein the sound suppressor is formed by a process comprising the steps of:

forming the structure on the rifle barrel, including over-molding or over-injecting the material over the rifle barrel so that the structure comprises the housing, the structure and the rifle barrel form an integral assembly, and the housing of the structure extends longitudinally and distally from a proximal end of the rifle barrel;

inserting the sound suppressing element inside the housing of the structure such that the structure houses and radially surrounds the sound suppressing element and couples the sound suppressing element to the rifle barrel, including disposing the plurality of mating components together along the longitudinal plane coextensive with the axis of the rifle barrel such that the opposing mating faces of the mating components are coplanar with the longitudinal plane.

20. The rifle of claim 19, wherein a portion of the over-molded or over-injected material is in direct contact with the rifle barrel.

21. The rifle of claim 19, wherein the housing surrounds a majority of the sound suppressing element.

* * * * *